US012486104B2

(12) United States Patent
Gu et al.

(10) Patent No.: US 12,486,104 B2
(45) Date of Patent: Dec. 2, 2025

(54) EXPLOSION-PROOF INTELLIGENT TEMPERATURE CONTROL TANK CONTAINER

(71) Applicants: NANTONG TANK CONTAINER CO., LTD., Jiangsu (CN); SQUARE TECHNOLOGY GROUP CO., LTD, Jiangsu (CN)

(72) Inventors: Hongfei Gu, Nantong (CN); Chenchen Zhang, Nantong (CN)

(73) Assignees: NANTONG TANK CONTAINER CO., LTD., Jiangsu (CN); SQUARE TECHNOLOGY GROUP CO., LTD, Jiangsu (CN)

( * ) Notice: Subject to any disclaimer, the term of this patent is extended or adjusted under 35 U.S.C. 154(b) by 111 days.

(21) Appl. No.: 18/689,554

(22) PCT Filed: Apr. 7, 2022

(86) PCT No.: PCT/CN2022/085607

§ 371 (c)(1),
(2) Date: Mar. 6, 2024

(87) PCT Pub. No.: WO2023/035607

PCT Pub. Date: Mar. 16, 2023

(65) Prior Publication Data

US 2024/0383673 A1 Nov. 21, 2024

(30) Foreign Application Priority Data

Sep. 7, 2021 (CN) ..... 202111042117.2

(51) Int. Cl.
*B65D 88/74* (2006.01)

(52) U.S. Cl.
CPC ..... *B65D 88/744* (2013.01)

(58) Field of Classification Search
CPC .... B65D 25/385; B65D 88/74; B65D 88/744; B65D 88/748; B65D 90/22; B65D 90/46
See application file for complete search history.

(56) References Cited

U.S. PATENT DOCUMENTS

2003/0028336 A1 2/2003 Masar et al.
2013/0002443 A1 1/2013 Breed et al.

FOREIGN PATENT DOCUMENTS

CN 101332931 A 12/2008
CN 102220947 A 10/2011
(Continued)

OTHER PUBLICATIONS

CN 207107483 (English translation) (Year: 2018).*

*Primary Examiner* — Jonathan Bradford
(74) *Attorney, Agent, or Firm* — Birch, Stewart, Kolasch & Birch, LLP

(57) ABSTRACT

An explosion-proof intelligent temperature control tank container comprises a tank heat exchange tube system (4), the tank heat exchange tube system (4) being connected to an explosion-proof refrigeration unit (11) and an explosion-proof heating module (23), the explosion-proof refrigeration unit (11) being connected to an external pipeline (6), and an explosion-proof circulating liquid temperature sensor (8), an explosion-proof liquid level switch (9) and an inlet and outlet pipeline valve (10) are arranged on the external pipeline (6). The present explosion-proof intelligent temperature control tank container uses an explosion-preventing design, can be used normally in a specified explosion hazard environment, can monitor the state of cargo and equipment in real time, and can remotely operate and control equipment by means of a background system to prevent explosions.

6 Claims, 6 Drawing Sheets

(56) References Cited

FOREIGN PATENT DOCUMENTS

| | | | |
|---|---|---|---|
| CN | 102530442 | A | 7/2012 |
| CN | 103144642 | A | 6/2013 |
| CN | 203731726 | U | 7/2014 |
| CN | 104602926 | A | 5/2015 |
| CN | 205102851 | U | 3/2016 |
| CN | 205820071 | U | 12/2016 |
| CN | 206531216 | U | 9/2017 |
| CN | 206531217 | U | 9/2017 |
| CN | 207456996 | U | 6/2018 |
| CN | 109703932 | A | 5/2019 |
| CN | 110884787 | A | 3/2020 |
| CN | 210794378 | U | 6/2020 |
| CN | 212530808 | U | 2/2021 |
| CN | 213938236 | U | 8/2021 |
| CN | 113697311 | A | 11/2021 |
| WO | WO 2018/102959 | A1 | 6/2018 |
| WO | WO 2020/152684 | A1 | 7/2020 |

* cited by examiner

EXPLOSION-PROOF INTELLIGENT TEMPERATURE CONTROL TANK CONTAINER

TECHNICAL FIELD

The present invention relates to the field of mobile liquid transportation devices, and in particular, to an intelligent temperature control tank container having explosion-proof design.

BACKGROUND

Currently, a refrigeration heating tank container is configured as a special tank container which can realize heat preservation, cooling and heating of goods by a refrigeration heating system attached to the tank container, and is configured to store and transport goods with special temperature control requirements. A conventional refrigeration tank container does not have special explosion-proof design, an adopted refrigeration and control system has no explosion-proof performance, and the tank container cannot be run and used in an explosive hazardous environment. For some special dangerous goods, key parameters, such as a temperature, a pressure, a liquid level, a grounding state, or the like, are required to be monitored in real time to guarantee storage and transportation safety of the goods.

As a transportation device, the tank container is mostly subjected to long-distance transportation all over the world, and an environmental temperature is complex and changeable in a transportation process. Some liquid goods are sensitive to the temperature and have high requirements for the storage temperature, such that the tank container is required to be capable of resisting an influence of an outside air temperature in the transportation process, the goods are always kept in a certain temperature range, and therefore, an intelligent temperature control system and a heat preservation structure are required to be added on the tank container. Design and manufacture of a conventional tank container product with a temperature control system on the market cannot meet explosion-proof requirements for use in the explosive hazardous environment. The tank container cannot be electrified to run in some places, such as factories, warehouses, or the like, with explosion risks. During leakage of stored and transported combustible goods, explosion accidents may be caused.

SUMMARY

An object of the present invention is to provide an explosion-proof intelligent temperature control tank container to solve the problems in the background.

In order to achieve the above objectives, the present invention provides the following technical solutions: An explosion-proof intelligent temperature control tank container, comprising a tank container body, the tank container body comprising a frame, an external thermal insulation layer and a tank, wherein a tank heat exchange tube system is provided on an outer surface of the tank, the tank heat exchange tube system is connected with an explosion-proof refrigeration unit by a connecting pipeline, the explosion-proof refrigeration unit is further connected with an external pipeline, the external pipeline is provided with an explosion-proof circulating liquid temperature sensor, an explosion-proof liquid level switch and an inlet and outlet pipeline valve, an explosion-proof heating module is provided in the explosion-proof refrigeration unit, the explosion-proof refrigeration unit is fixed on a bottom longitudinal beam of the frame by a supporting structure, the frame is provided with a cable storage box an explosion-proof control box is further provided on the bottom longitudinal beam of the frame, an electric control system is provided in the explosion-proof control box, an explosion-proof goods temperature sensor is provided on the tank, an explosion-proof electrostatic grounding detection alarm, an explosion-proof remote display control box, an explosion-proof remote isolating switch, a grounding probe, an explosion-proof intelligent display and a temperature sensor are provided at a rear end of the tank, the explosion-proof electrostatic grounding detection alarm is connected with the grounding probe, an explosion-proof remote communication positioning control terminal is provided in an upper region of the tank, a first safety valve, a second safety valve, a manhole, a liquid level sensor, a gas phase interface, a standby port, a top discharge port and a pressure sensor are provided at a top of the tank, and a bottom discharge port is provided at a bottom of the tank.

The invention is further improved by: an expansion tank is provided at the top of the tank, and the expansion tank is connected with the tank heat exchange tube system.

The invention is further improved by: an overheat protection sensor is provided on the explosion-proof heating module.

The invention is further improved by: the explosion-proof goods temperature sensor detects and feeds back a real-time goods temperature through a detection port, and the explosion-proof goods temperature sensor is protected by a goods temperature sensor protection assembly.

The invention is further improved by: a hollowed-out cable protection bridge is provided on the frame.

The invention is further improved by: the electric control system controls a compressor refrigerating system and the explosion-proof heating module in the explosion-proof refrigeration unit to refrigerate or heat cold and hot circulating fluid, the explosion-proof circulating fluid temperature sensor, the explosion-proof liquid level switch, the explosion-proof goods temperature sensor and the explosion-proof remote isolating switch are all connected with the electric control system, and the explosion-proof remote communication positioning control terminal is connected with the electric control system, the explosion-proof intelligent display, the liquid level sensor, the pressure sensor, the temperature sensor and the explosion-proof electrostatic grounding detection alarm, can acquire information of a position, a temperature, a pressure, a liquid level and a grounding state of the tank container in real time at the background, can set key parameter alarming, and meanwhile can control the explosion-proof refrigeration unit and the explosion-proof heating module: the explosion-proof remote display control box is also connected with the electric control system.

Compared with a prior art, the present invention has the following beneficial effects.

In the present invention, special explosion-proof design is adopted, the tank container can be normally used in a specific explosive hazardous environment, states of goods and devices can be monitored in real time, and the devices can be remotely operated and controlled by a background system, so as to prevent an environmental explosion caused by accidents under conditions of goods loading and unloading, electrical device operation, or the like, in goods storage and transportation.

Figure 1:
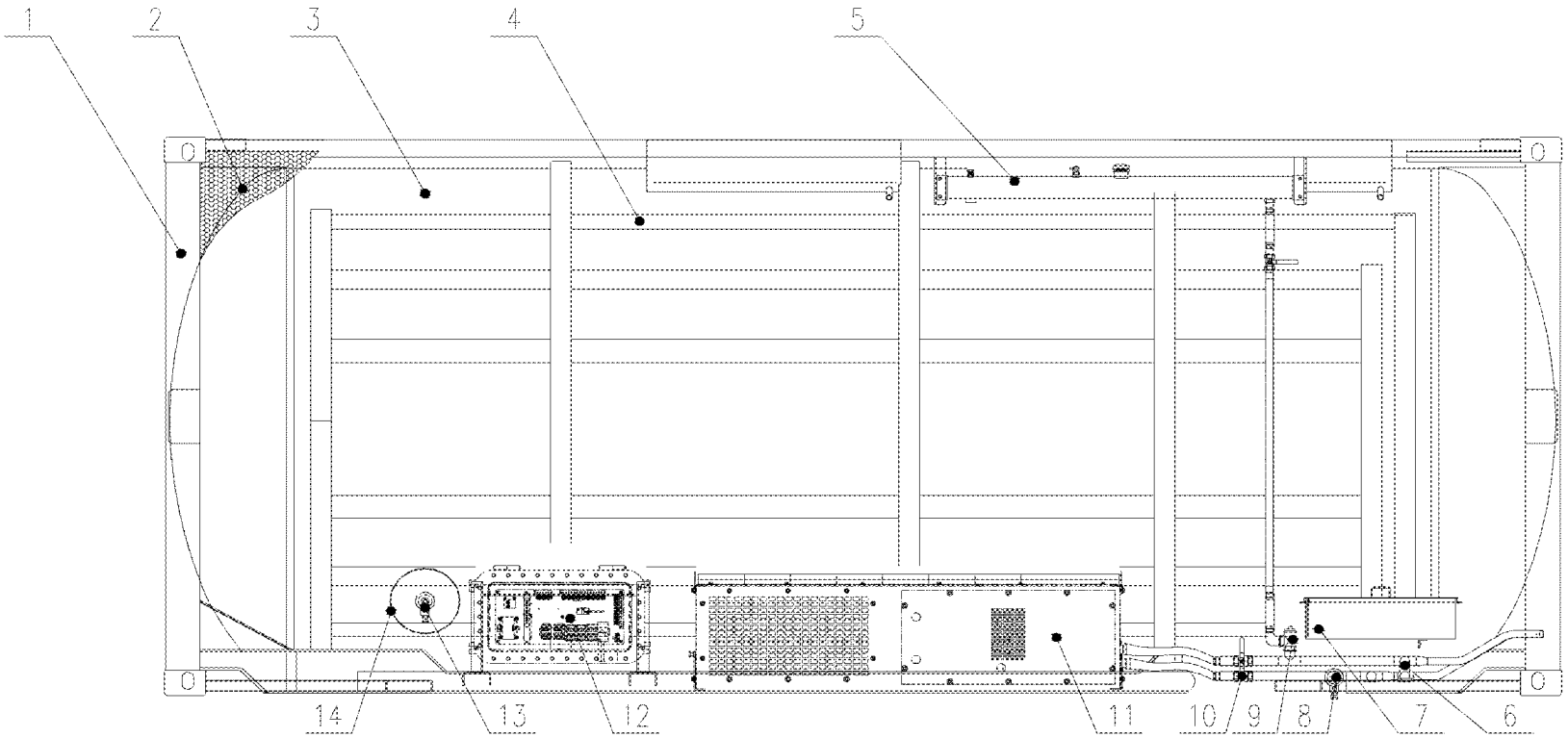
FIG. 1 is a schematic structural diagram of the explosion-proof intelligent temperature control tank container according to the present invention.
Figure 2:
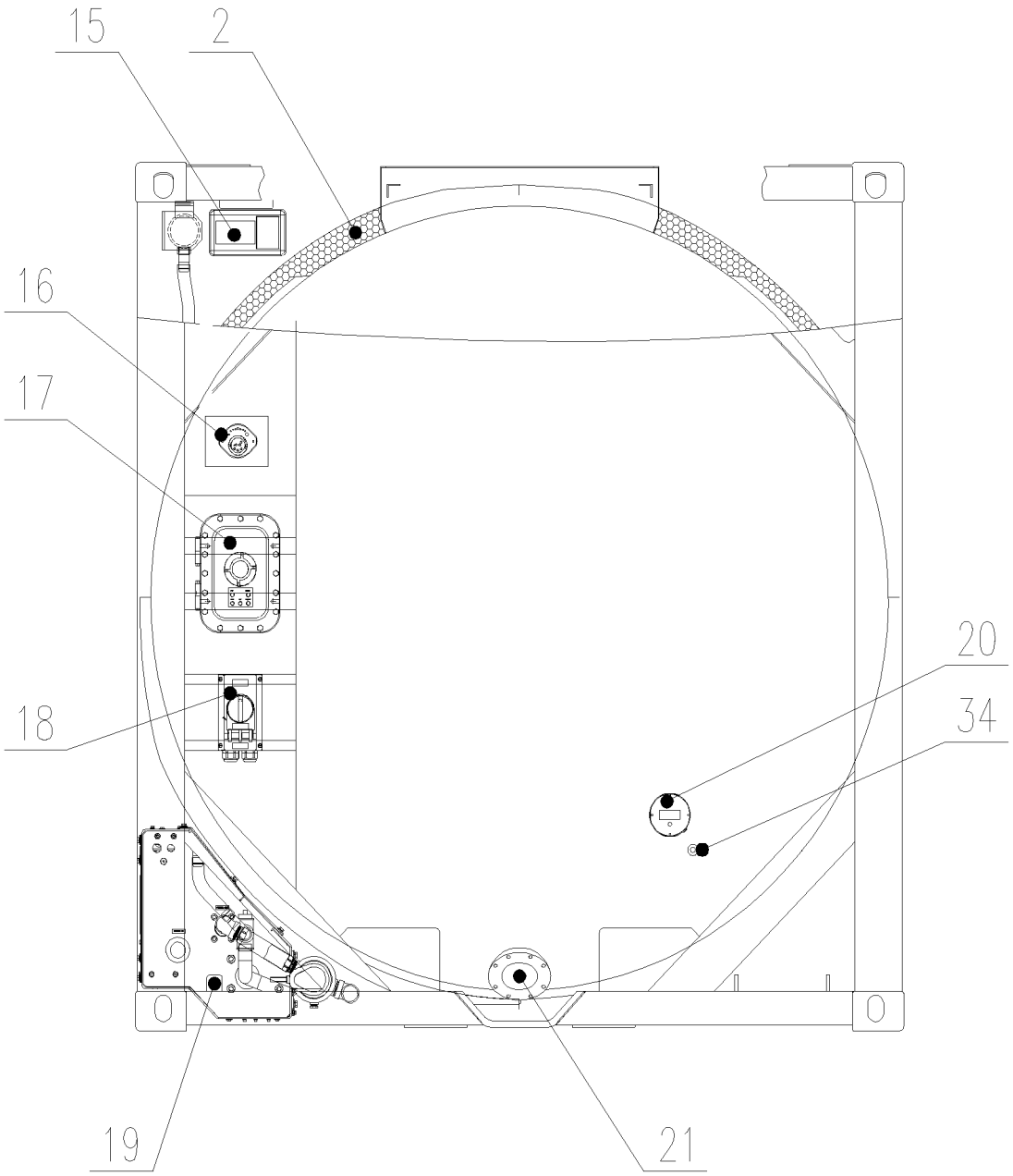
FIG. 2 is a schematic structural diagram of a rear end of the explosion-proof intelligent temperature control tank container in the present invention.
Figure 3:
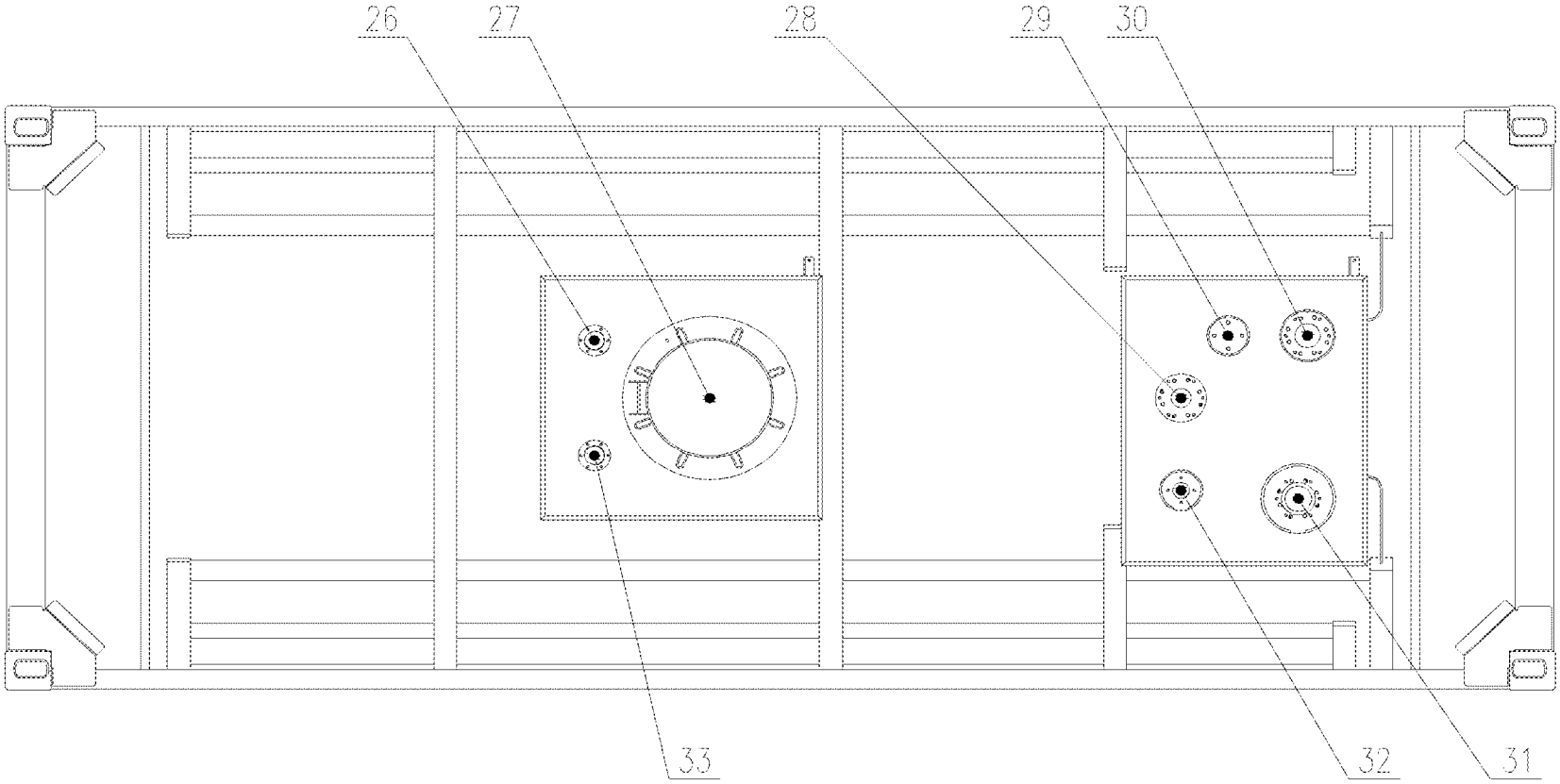
FIG. 3 is a schematic structural diagram of an upper region of the explosion-proof intelligent temperature control tank container in the present invention.
Figure 4:
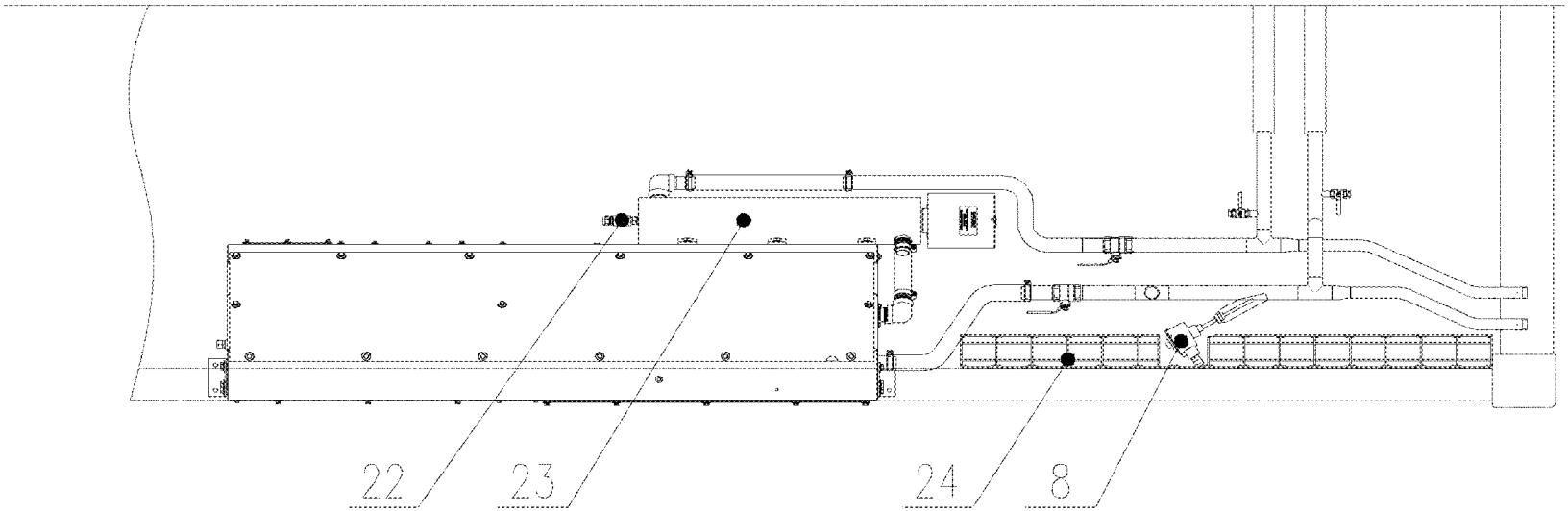
FIG. 4 is a schematic structural diagram of an explosion-proof refrigeration unit.
Figure 5:
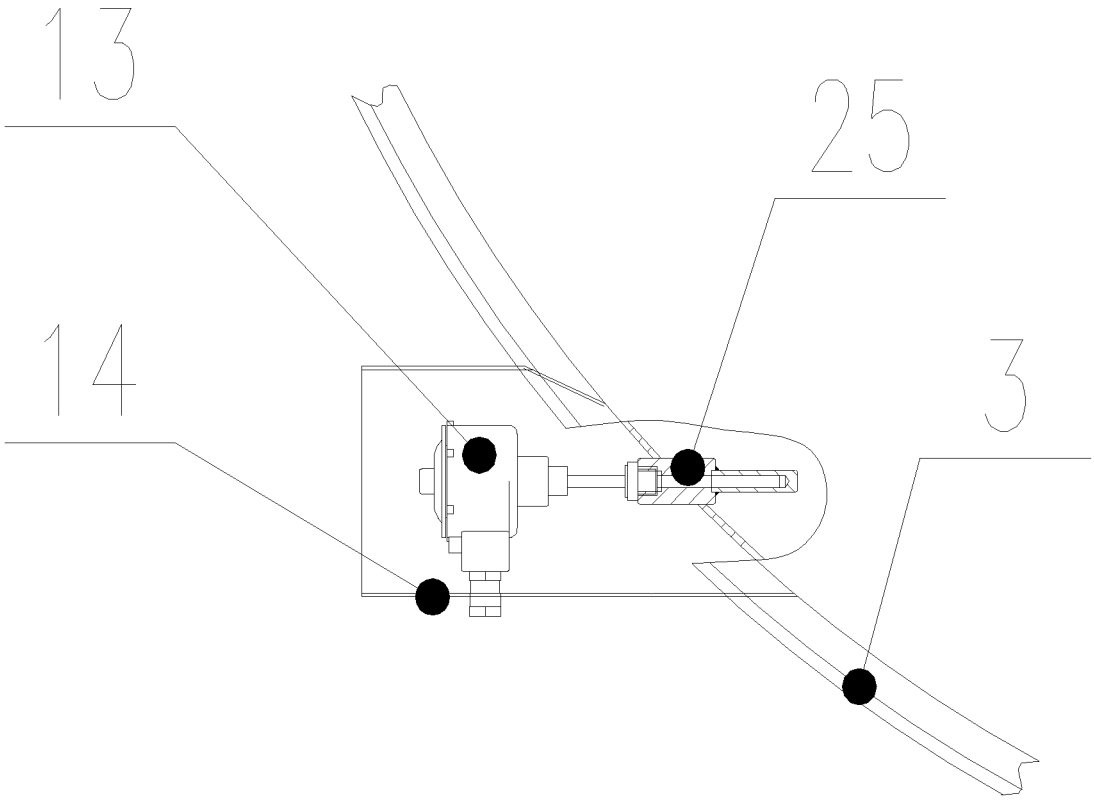
FIG. 5 is a schematic structural diagram of an explosion-proof goods temperature sensor.
Figure 6:
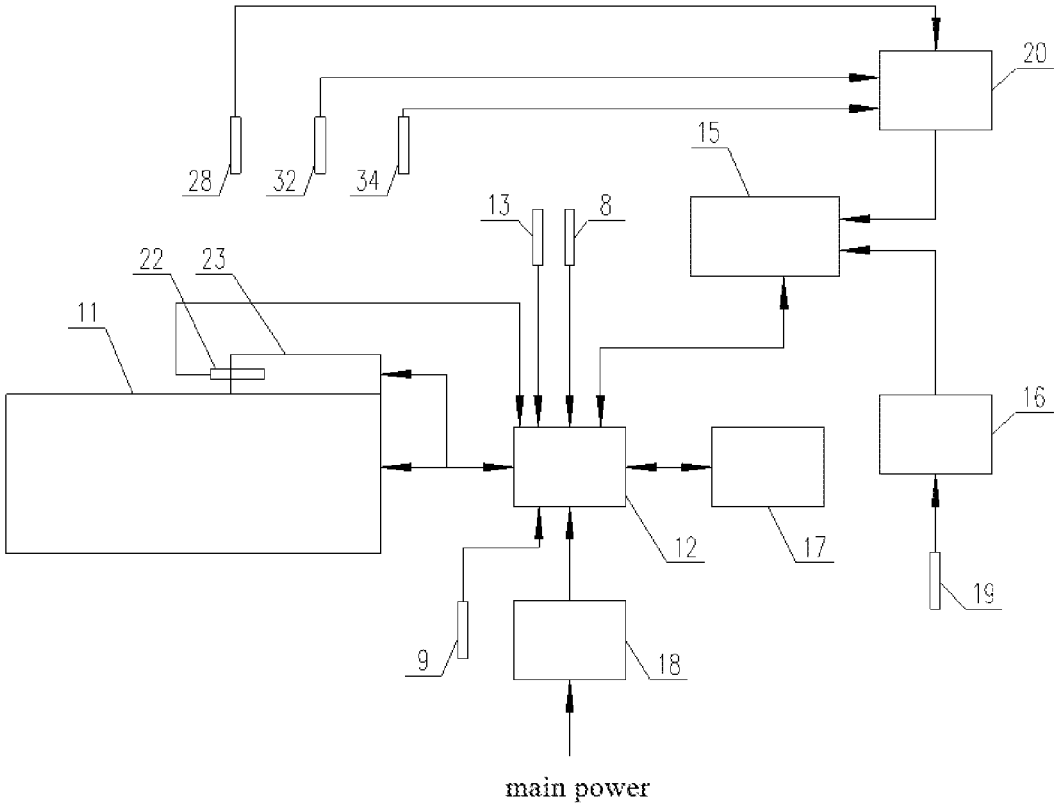
FIG. 6 is a control principle diagram according to the present invention.

Reference numerals: 1—frame, 2—external thermal insulation layer, 3—tank, 4—tank heat exchange tube system, 5—expansion tank, 6—external pipeline, 7—cable storage box, 8—explosion-proof circulating liquid temperature sensor, 9—explosion-proof liquid level switch, 10—inlet and outlet pipeline valve, 11—explosion-proof refrigeration unit, 12—explosion-proof control box, 13—explosion-proof goods temperature sensor, 14—goods temperature sensor protection assembly, 15—explosion-proof remote communication positioning control terminal, 16—explosion-proof electrostatic grounding detection alarm, 17—explosion-proof remote display control box, 18—explosion-proof remote isolating switch, 19—grounding probe, 20—explosion-proof intelligent display, 21—bottom discharge port, 22-overheat protection sensor, 23-explosion-proof heating module, 24-hollowed-out cable protection bridge, 25—detection port, 26—first safety valve, 27—manhole, 28—liquid level sensor, 29—gas phase interface, 30—standby port, 31—top discharge port, 32—pressure sensor, 33—second safety valve, and 34—temperature sensor.

DETAILED DESCRIPTION

The technical solutions in the embodiments of the present invention are clearly and completely described with reference to the accompanying drawings in the embodiments of the present invention, and apparently, the described embodiments are not all but only a part of the embodiments of the present invention. All other embodiments obtained by a person of ordinary skill in the art based on the embodiments of the present invention without creative efforts shall fall within the protection scope of the present invention.

It should be noted that the embodiments in the present application and features in the embodiments may be combined with each other without conflicts. The present invention will be described in detail below with reference to the accompanying drawings in conjunction with an embodiment.

The present embodiment provides a technical solution: an explosion-proof intelligent temperature control tank container includes a tank container body, an explosion-proof refrigeration heating and temperature control system, an explosion-proof remote positioning and communication system and an explosion-proof sensor.

As shown in the drawings, the tank container body includes a frame 1, an external thermal insulation layer 2 and a tank 3, a tank heat exchange tube system 4 is provided on an outer surface of the tank 3, and cold and hot fluid is utilized to exchange heat with goods in the tank through a wall of the tank to refrigerate and heat the goods. The tank heat exchange tube system 4 is connected with an explosion-proof refrigeration unit 11 by a connecting pipeline, the explosion-proof refrigeration unit 11 is further connected with an external pipeline 6, the external pipeline 6 is provided with an explosion-proof circulating liquid temperature sensor 8, an explosion-proof liquid level switch 9 and an inlet and outlet pipeline valve 10, instant temperature parameters of the cold and hot circulating fluid are detected and fed back by the explosion-proof circulating liquid temperature sensor 8, a signal can be fed back to a controller by the explosion-proof liquid level switch 9 when a liquid level is excessively low, device running is cut off in time, and an alarm is given, so as to avoid an accident. An expansion tank 5 is provided at a top of the tank 3, and the expansion tank 5 is connected with the tank heat exchange tube system 4 and configured to supplement and accommodate liquid when the circulating fluid expands with heat and contracts with cold, discharge gas in the tank heat exchange tube system 4 and maintain pressure balance of the tank heat exchange tube system 4. The frame 1 outside the tank 3 is provided with a cable storage box 7 for storing a power line and a plug. The explosion-proof refrigeration unit 11 is additionally provided with an explosion-proof heating module 23, the explosion-proof refrigeration unit and an explosion-proof control box 12 are fixed on a bottom longitudinal beam of the frame 1 by a supporting structure, and an electric control system is provided in the explosion-proof control box 12. An overheat protection sensor 22 is provided in the explosion-proof heating module 23, and when the electric control system detects that a heater is overheated, a heating loop can be immediately cut off. An explosion-proof goods temperature sensor 13 detects and feeds back a real-time goods temperature through a detection port 25, and the explosion-proof goods temperature sensor 13 is protected by a goods temperature sensor protection assembly 14. A top of the tank 3 is provided with a first safety valve 26, a second safety valve 33, a manhole 27, a liquid level sensor 28, a gas phase interface 29, a standby port 30, a top discharge port 31 and a pressure sensor 32, and a bottom of the tank 3 is provided with a bottom discharge port 21. In order to facilitate a user to check device parameters and operate a control system in places with limited spaces, such as container ships, storage yards, or the like, an explosion-proof remote display control box 17, an explosion-proof remote isolating switch 18 and a temperature sensor 34 are provided at a rear end of the tank 3, and an explosion-proof intelligent display 20 can display parameters measured by the temperature sensor 34, the liquid level sensor 28 and the pressure sensor 32 in real time. An explosion-proof remote communication positioning control terminal 15 is provided at an upper region of the tank 3, and the explosion-proof remote communication positioning control terminal 15 is connected with the electric control system, the explosion-proof intelligent display 20, the liquid level sensor 28, the pressure sensor 32, the temperature sensor 34 and an explosion-proof electrostatic grounding detection alarm 16, can acquire information of the tank container, such as a position, a temperature, a pressure, the liquid level, a grounding state, or the like, in real time at the background, can set key parameter alarming, and meanwhile can remotely control an explosion-proof refrigeration heating system. The electrostatic grounding sensor 16 and a grounding probe 19 are provided at the rear end of the tank 3 to facilitate inspection and assurance of a grounding connection state during operation. The frame 1 is provided with a hollowed-out cable protection bridge 24 for fixing and protecting an external connection cable and preventing dangerous materials from being accumulated on the cable.

All electrical components of a body of the explosion-proof refrigeration unit 11 are explosion-proof. The cold and hot circulating fluid is refrigerated or heated by a compressor refrigerating system in the explosion-proof refrigeration unit 11 and an electric heating system in the explosion-proof heating module 23, and enters the tank heat exchange tube system 4 through the connecting pipeline to circulate under an action of a circulating pump in the explosion-proof refrigeration unit 11, so as to exchange heat with the goods in the tank, thereby achieving effects of reducing, raising and maintaining the temperature of the goods.

For sensitive dangerous goods, an explosion-proof temperature control and monitoring system adopted in the present invention can effectively control and monitor key parameter states of the goods and devices to improve safety of goods transportation and storage. When the device is in an explosive hazardous environment, environmental explosion fire caused by running of the device can be avoided under proper operation and use. Compared with a conventional refrigeration heating tank container, the tank container according to the present invention has higher safety and wider adaptability.

Elements of a refrigeration heating device, a communication monitoring device and the mounted sensors all have explosion-proof design. In the present invention, a metal explosion-proof shell is adopted as the split control box, and electric appliance components, such as the controller, the switch, an actuating element, a wiring terminal, or the like, of the refrigeration heating system are all sealed in the explosion-proof shell. A control center is connected with the remote communication terminal, and can monitor a running state of the device from the background in real time and realize remote control operation. In the present invention, a structure of a side edge beam at a bottom of the tank container is optimized, and after analysis and calculation, on the basis of safety of structural strength, forms of notch avoidance and structural reinforcement are adopted to provide sufficient spaces for mounting of the large-size explosion-proof refrigeration heating device on the tank container with a large volume. In the present invention, the tank container is integrally covered by a high-performance thermal insulation material, thus improving a thermal insulation effect. In the present invention, the separated explosion-proof temperature, pressure and liquid level sensors are mounted at corresponding parts of the tank, and information parameters are transmitted to the background through the explosion-proof communication terminal, so as to realize real-time monitoring. The explosion-proof electrostatic grounding sensor is connected with the grounding probe to monitor and detect the grounding state of the tank container in real time, a sound-light alarm is provided when grounding is abnormal, and an alarm signal is transmitted to a remote monitoring platform. In the present invention, the cable protection bridge is adopted to lay an external line, so as to prevent the cable from being damaged by foreign objects, and the bridge is of a hollowed-out grid structure, thus preventing media from being accumulated on the cable.

It is to be noted that terms used herein only aim to describe specific embodiments, and are not intended to limit exemplary embodiments of this application. Unless otherwise directed by the context, singular forms of terms used herein are intended to include plural forms. Besides, it will be also appreciated that when terms "contain" and/or "include" are used in the description, it is indicated that features, steps, operations, devices, assemblies and/or a combination thereof exist.

It should be noted that the terms "first", "second", or the like, in the description and claims of the present application and in the foregoing drawings are used for distinguishing between similar objects and not necessarily for describing a particular sequential or chronological order. It should be understood that terms thus used are interchangeable in proper circumstances, such that for example, the embodiments of the present application described herein can be implemented in orders except the orders illustrated or described herein. Furthermore, the terms "comprise", "have" and any variation thereof are intended to cover non-exclusive inclusion: for example, a process, system, product, or device comprising a list of steps or units is not necessarily limited to those steps or units explicitly listed, but may include other steps or units not expressly listed or inherent to such a process, product, or device.

For ease of description, spatial relative terms such as "over", "above", "on an upper surface" and "upper" may be used herein for describing a spatial position relation between a device or feature and other devices or features shown in the drawings. It will be appreciated that the spatial relative terms aim to contain different orientations in usage or operation besides the orientations of the devices described in the drawings. For example, if the devices in the drawings are inverted, devices described as "above other devices or structures" or "over other devices or structures" will be located as "below other devices or structures" or "under other devices or structures". Thus, an exemplary term "above" may include two orientations namely "above" and "below". The device may be located in other different modes (rotated by 90 degrees or located in other orientations), and spatial relative descriptions used herein are correspondingly explained.

Exemplary embodiments of the present application will now be described in more detail with reference to the accompanying drawings. These exemplary embodiments may, however, be implemented in many different forms and should not be construed as limited to the embodiments set forth herein. It should be understood that these embodiments are provided to make the disclosure of the present application thorough and complete, and fully convey the concept of the exemplary embodiments to those skilled in the art, and in the drawings, the thicknesses of layers and regions may be enlarged for clarity, and the same reference numerals are used to designate the same devices, and thus, the description thereof will be omitted.

Although embodiments of the present invention have been shown and described, it will be appreciated by those skilled in the art that various changes, modifications, substitutions and alterations can be made in these embodiments without departing from the principles and spirit of the invention, the scope of which is defined in the appended claims and their equivalents.

What is claimed is:

1. An explosion-proof intelligent temperature control tank container, comprising a tank container body, the tank container body comprising a frame, an external thermal insulation layer and a tank, wherein a tank heat exchange tube system is provided on an outer surface of the tank, the tank heat exchange tube system is connected with an explosion-proof refrigeration unit by a connecting pipeline, the explosion-proof refrigeration unit is further connected with an external pipeline, the external pipeline is provided with an explosion-proof circulating liquid temperature sensor, an explosion-proof liquid level switch and an inlet and outlet pipeline valve, an explosion-proof heating module is provided in the explosion-proof refrigeration unit, the explosion-proof refrigeration unit is fixed on a bottom longitudinal beam of the frame by a supporting structure, the frame is provided with a cable storage box, an explosion-proof control box is further provided on the bottom longitudinal beam of the frame, an electric control system is provided in the explosion-proof control box, an explosion-proof goods temperature sensor is provided on the tank, an explosion-proof electrostatic grounding detection alarm, an explosion-proof remote display control box, an explosion-proof remote isolating switch, a grounding probe, an explosion-proof intelligent display and a temperature sensor are provided at a rear end of the tank, the explosion-proof electrostatic grounding detection alarm is connected with the grounding probe, an explosion-proof remote communication positioning control terminal is provided in an upper region of the tank, a first safety valve, a second safety valve, a manhole, a liquid level sensor, a gas phase interface, a standby port, a top discharge port and a pressure sensor are provided at a top of the tank, and a bottom discharge port is provided at a bottom of the tank.

2. The explosion-proof intelligent temperature control tank container according to claim 1, wherein an expansion tank is provided at the top of the tank, and the expansion tank is connected with the tank heat exchange tube system.

3. The explosion-proof intelligent temperature control tank container according to claim 1, wherein an overheat protection sensor is provided on the explosion-proof heating module.

4. The explosion-proof intelligent temperature control tank container according to claim 1, wherein the explosion-proof goods temperature sensor detects and feeds back a real-time goods temperature through a detection port, and the explosion-proof goods temperature sensor is protected by a goods temperature sensor protection assembly.

5. The explosion-proof intelligent temperature control tank container according to claim 1, wherein a hollowed-out cable protection bridge is provided on the frame.

6. The explosion-proof intelligent temperature control tank container according to claim 1, wherein the electric control system controls a compressor refrigerating system and the explosion-proof heating module in the explosion-proof refrigeration unit to refrigerate or heat cold and hot circulating fluid, the explosion-proof circulating fluid temperature sensor, the explosion-proof liquid level switch, the explosion-proof goods temperature sensor and the explosion-proof, remote isolating switch are all connected with the electric control system, and the explosion-proof remote communication positioning control terminal is connected with the electric control system, the explosion-proof intelligent display, the liquid level sensor, the pressure sensor, the temperature sensor and the explosion-proof electrostatic grounding detection alarm, can acquire information of a position, a temperature, a pressure, a liquid level and a grounding state of the tank container in real time at the background, can set key parameter alarming, and meanwhile can control the explosion-proof refrigeration unit and the explosion-proof heating module; the explosion-proof remote display control box is also connected with the electric control system.

* * * * *